US011574787B2

(12) United States Patent
Hong

(10) Patent No.: US 11,574,787 B2
(45) Date of Patent: Feb. 7, 2023

(54) THERMAL CUTOFF

(71) Applicant: XIAMEN SET ELECTRONICS CO., LTD, Xiamen (CN)

(72) Inventor: Yaoxiang Hong, Xiamen (CN)

(73) Assignee: XIAMEN SET ELECTRONICS CO., LTD, Xiamen (CN)

( * ) Notice: Subject to any disclaimer, the term of this patent is extended or adjusted under 35 U.S.C. 154(b) by 0 days.

(21) Appl. No.: 17/293,032

(22) PCT Filed: Sep. 20, 2019

(86) PCT No.: PCT/CN2019/106991
§ 371 (c)(1),
(2) Date: May 11, 2021

(87) PCT Pub. No.: WO2020/186717
PCT Pub. Date: Sep. 24, 2020

(65) Prior Publication Data

US 2022/0005662 A1 Jan. 6, 2022

(30) Foreign Application Priority Data

Mar. 20, 2019 (CN) ..... 201920354461.7

(51) Int. Cl.
*H01H 85/08* (2006.01)
*H01H 85/38* (2006.01)
(Continued)

(52) U.S. Cl.
CPC ..... *H01H 85/38* (2013.01); *H01H 85/048* (2013.01); *H01H 85/06* (2013.01);
(Continued)

(58) Field of Classification Search
CPC ..... H01H 85/042; H01H 85/06; H01H 85/08; H01H 85/12; H01H 85/143; H01H 85/175;
(Continued)

(56) References Cited

U.S. PATENT DOCUMENTS 4,617,433 A * 10/1986 Hoshikawa ..... H01H 3/142 264/171.15
5,287,079 A * 2/1994 Bernardi ..... H01H 85/0417 337/250
(Continued)

FOREIGN PATENT DOCUMENTS

CN 101859665 A 10/2010
CN 201638772 U 11/2010
(Continued)

OTHER PUBLICATIONS

CN207097772U Translation.*
CN205900482U Translation.*

*Primary Examiner* — Jacob R Crum
(74) *Attorney, Agent, or Firm* — Bayramoglu Law Offices LLC

(57) ABSTRACT

A thermal cutoff at least includes a current-carrying fusible element having two ends connected to a first electrode and a second electrode. The current-carrying fusible element is provided in a closed cavity bounded by a housing having an opening at one end, a cover plate, and a sealant. The thermal cutoff further includes a first lead wire and a second lead wire each wrapped by an insulating sheath. One end of the first lead wire and one end of the second lead wire are electrically connected to the first electrode and the second electrode. The sealant is filled in the opening of the housing, covers an electrical joint between the first lead wire and a first electrode plate and an end of the first lead wire, and also
(Continued)

covers an electrical joint between a second electrode plate and the second lead wire and an end of the second lead wire.

15 Claims, 6 Drawing Sheets

(51) Int. Cl.
*H01H 85/048* (2006.01)
*H01H 85/06* (2006.01)
*H01H 85/143* (2006.01)

(52) U.S. Cl.
CPC ..... *H01H 85/08* (2013.01); *H01H 85/143* (2013.01); *H01H 2085/0483* (2013.01); *H01H 2085/383* (2013.01)

(58) Field of Classification Search
CPC ..... H01H 85/38; H01H 2085/0483; H01H 2085/383
See application file for complete search history.

(56) References Cited

U.S. PATENT DOCUMENTS

2001/0048579 A1* 12/2001 Kanamaru ..... H01H 85/0411 361/103
2004/0085178 A1* 5/2004 Tanaka ..... C22C 12/00 337/159
2007/0025042 A1* 2/2007 Nishikawa ..... H01H 37/761 361/104
2015/0380196 A1* 12/2015 Darr ..... H01H 85/153 337/201
2017/0004947 A1* 1/2017 Hong ..... H01H 85/38

FOREIGN PATENT DOCUMENTS

CN 203398063 U 1/2014
CN 205723413 U 11/2016
CN 205900482 U 1/2017
CN 207097772 U 3/2018
CN 208093500 U 11/2018
JP 2009087892 A 4/2009

* cited by examiner

THERMAL CUTOFF

CROSS REFERENCE TO THE RELATED APPLICATIONS

This application is the national phase entry of International Application No. PCT/CN2019/106991, filed on Sep. 20, 2019, which is based upon and claims priority to Chinese Patent Application No. 201920354461.7, filed on Mar. 20, 2019, the entire contents of which are incorporated herein by reference.

TECHNICAL FIELD

The present invention relates to a fusible thermal cutoff, and in particular, to a waterproof high-voltage thermal cutoff.

BACKGROUND

Sealing protection requirements on internal high-voltage circuits and electronic components of electric vehicles are significantly more strict than those used in conjunction with traditional fuel vehicles, especially the requirements on thermal management and design of battery packs. To ensure the safety performance of electric vehicles in extreme environments such as torrential rain or submersion in water, the positive temperature coefficient (PTC) heater preferably requires a waterproof rating of IPX7 or higher to avoid electric shock inside or around the vehicle. Due to the high voltage of electric vehicles, an electrical leakage may cause more severe injuries. At present, adding a high-voltage thermal cutoff to the main circuit of the PTC heater has become a standard routine. However, waterproof high-voltage thermal cutoffs are currently unavailable on the market.

For example, the applicant previously proposed a thermal cutoff, as disclosed in Chinese patent No. CN208093500U, in which the electrodes of the thermal cutoff are exposed. However, when the thermal cutoff is applied to an air conditioning system, an emphasis must be placed on waterproofing the lead terminal to meet safety requirements. In this regard, when the thermal cutoff is used at the client end, it is necessary to seal the entire mounting area with silicone rubber to waterproof it, which is clearly inconvenient in practical application. Adding to complications is the fact that the thermal cutoff is arranged axially. Consequently, since the wiring of the PTC heater is introduced from one side, when such an axial thermal cutoff is mounted, the wire harness at one end has to be folded back, and it is also necessary to weld a multi-stranded wire to at least the electrode at this end for folding back. This arrangement is not only inconvenient and requires substantial manhours, but also exposes the electrode and the weld, and thus cannot meet the sealing protection requirements.

SUMMARY

To solve the foregoing problems, the present invention provides a thermal cutoff that meets the sealing protection requirements.

The present invention provides a thermal cutoff, at least including a current-carrying fusible element having two ends connected to a first electrode and a second electrode, respectively. The current-carrying fusible element is provided in a closed cavity bounded by a housing having an opening at one end, a cover plate, and a sealant. The thermal cutoff further includes a first lead wire and a second lead wire each wrapped by an insulating sheath. One end of the first lead wire and one end of the second lead wire are electrically connected to the first electrode and the second electrode, respectively. The sealant is filled in the opening of the housing, at least covers an electrical joint between the first lead wire and a first electrode plate and an end of the first lead wire, and also covers an electrical joint between a second electrode plate and the second lead wire and an end of the second lead wire.

Another thermal cutoff is disclosed, including a current-carrying fusible element and a high-voltage fusible element that each have both ends connected in parallel to a first electrode and a second electrode. The current-carrying fusible element and the high-voltage fusible element are provided in a closed cavity bounded by a housing having an opening at one end, a cover plate, and a sealant. The thermal cutoff further includes a first lead wire and a second lead wire each wrapped by an insulating sheath. One end of the first lead wire and one end of the second lead wire are electrically connected to the first electrode and the second electrode, respectively. The sealant is filled in the opening of the housing, at least covers an electrical joint between the first lead wire and a first electrode plate and an end of the first lead wire, and also covers an electrical joint between a second electrode plate and the second lead wire and an end of the second lead wire.

By adopting the foregoing technical solutions, the present invention implements a thermal cutoff with excellent sealing protection performance, which can be applied to the corresponding scenarios.

The above description is merely a summary of the technical solutions of the present invention. In order to make the technical means of the present invention more comprehensible to be implemented in accordance with the content of the specification, and in order to make the above and other objectives, features and advantages of the present invention more obvious and easily comprehensible, the specific implementations of the present invention are described below.

BRIEF DESCRIPTION OF THE DRAWINGS

To describe the technical solutions in the embodiments of the present invention or in the prior art more clearly, the following briefly describes the drawings illustrating the embodiments or the prior art. Apparently, the drawings in the following description show some embodiments of the present invention, and a person of ordinary skill in the art may still derive other drawings based on these drawings without creative efforts.

Figure 1:
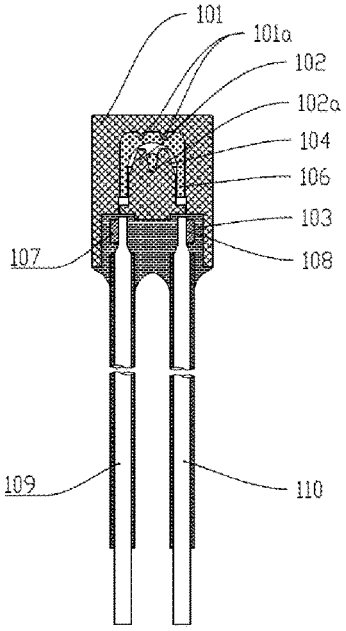
FIG. 1 is a cross-sectional view of a thermal cutoff according to Embodiment 1 of the present invention.

LIST OF REFERENCE NUMERALS housing: 101, 201, 301, 401, 501, 601
ridge: 101*a*, 601*a*
first cavity: 301*a*, 401*a*, 501*a*
second cavity: 301*b*, 401*b*, 501*b*
mounting hole: 301*c*, 401*c*
cover plate: 102, 202, 402, 502, 602
first cover plate: 302
second cover plate: 303
partition plate: 303*a*
bottom plate: 102*e*, 402*e*
first partition plate: 102*b*, 402*c*
second partition plate: 102*c*, 402*d*
third partition plate: 102*d*, 402*f*
undulating profiles: 102*a*, 402*b*, 402*a*, 602*a*
sealant: 103, 203, 304, 403, 503, 603
current carrier: 104, 204, 312, 404, 504, 604
fuse link: 105, 306, 406, 506
fusing agent: 106, 305, 405, 505, 606
arc extinguishing medium: 307, 407, 507
first electrode plate: 107, 207, 308, 408, 508, 607
second electrode plate: 108, 208, 309, 409, 509, 608
one end of the first electrode plate 408: 408*a*
one end of the second electrode plate 409: 409*a*
left terminal: 107*a*, 107*b*, 308*a*, 308*b*
right terminal: 108*a*, 108*b*, 309*a*, 309*b*
first lead wire: 109, 209, 310, 412, 512, 609
second lead wire: 110, 210, 311, 413, 513, 610
clamping notch: 408*b*, 409*b*

DETAILED DESCRIPTION OF THE EMBODIMENTS

In order to make the objectives, technical solutions and advantages of the embodiments of the present invention clearer, the following clearly and completely describes the technical solutions in the embodiments of the present invention with reference to the drawings in the embodiments of the present invention. Apparently, the described embodiments are some rather than all of the embodiments of the present invention. All other embodiments obtained by those of ordinary skill in the art based on the embodiments of the present invention without creative efforts shall fall within the scope of protection of the present invention.

To further illustrate the embodiments, the present invention provides the drawings. The drawings, as part of the disclosure of the present invention, are mainly used to illustrate the embodiments and explain the operating principles of the embodiments with reference to the related descriptions in this specification. With reference to such contents, those of ordinary skill in the art can understand other possible implementations and the advantages of the present invention. Components in the drawings are not drawn to scale, and similar reference numerals generally represent similar components.

The present invention is further described below with reference to the drawings and specific embodiments.

To overcome the shortcomings of the thermal cutoff in the prior art, the present invention provides a thermal cutoff with excellent sealing protection performance as follows.

Embodiment 1

Figure 2:
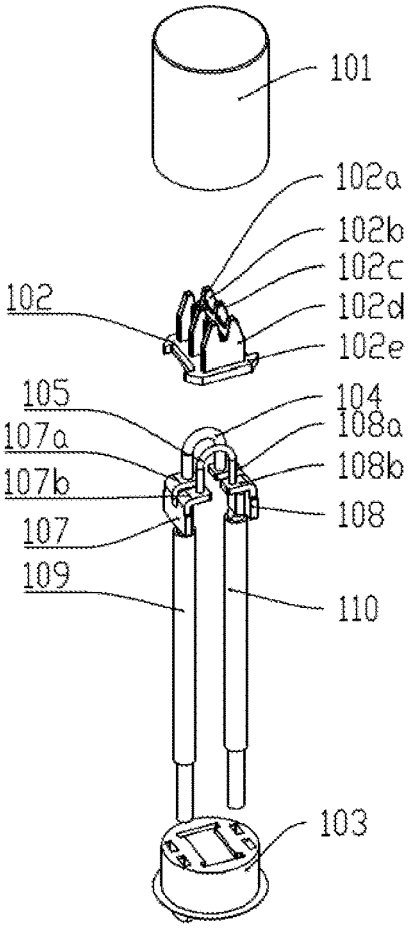
FIG. 2 is a schematic exploded view of the thermal cutoff according to Embodiment 1 of the present invention.

As shown in FIG. 1 and FIG. 2, in the thermal cutoff of the present embodiment, a current-carrying fusible element and a high-voltage fusible element in parallel are provided as core functional devices in a closed cavity bounded by the housing 101, the cover plate 102, and the sealant 103. Preferably, in the present embodiment, the housing 101, the cover plate 102 and the sealant 103 are made of materials with good insulation properties. For example, the housing 101 and the cover plate 102 are made of ceramic, and the sealant 103 is made of epoxy resin. It should be noted that, in the present embodiment, the housing 101 in a cylindrical shape is taken as an example for description, while the cover plate 102 and the sealant 103 adapted to the housing 101 also have matching shapes, but the shapes of the housing 101, the cover plate 102 and the sealant 103 in the present embodiment should not be limited thereto. Thus, a person skilled in the art can adopt different shapes according to different application scenarios and design requirements.

In the present embodiment, the parallel current-carrying fusible element and high-voltage fusible element serving as the core functional devices are shown as the U-shaped current carrier 104 and the U-shaped fuse link 105 arranged in parallel. The current carrier 104 and the fuse link 105 are both made of fusible alloys. The fusible alloy generally refers to metal with a melting point lower than 300° C. and alloys thereof. For example, the fusible alloy is made of Bi, Sn, Pb, In and other metal elements with low melting points. The melting point of the current carrier 104 is lower than the melting point of the fuse link 105, and the internal resistance value of the current carrier 104 is lower than the internal resistance value of the fuse link 105. Both ends of each of the U-shaped current carrier 104 and the fuse link 105 are provided with parallel segments. In this implementation, since the internal resistance value of the current carrier 104 is lower than the internal resistance value of the fuse link 105, when a normal operating current is conducting (the operating current generally does not exceed a rated current during actual long-time operation, except for the moment of startup), the current-carrying capacity is mainly provided by the current carrier 104 serving as the current-carrying fusible element with a lower internal resistance value than the fuse link 105.

In the present embodiment, the closed cavity bounded by the housing 101, the cover plate 102, and the sealant 103 is filled with the fusing agent 106 that contacts and wraps the current carrier 104 and the fuse link 105. The fusing agent 106 is selected from substances capable of reducing the surface tension of an alloy to be fused, for example, a solder paste made of rosin substances (natural rosin, synthetic rosin and the like). Under normal circumstances, the current mainly flows through the current carrier 104. When a protected device has an abnormal temperature rise, the temperature is transferred to the current carrier 104. When the temperature reaches the melting point of the current carrier 104, the current carrier 104 shrinks and breaks under the effect of the tension of the fusing agent 106, thereby breaking the parallel branch of the current carrier 104. At the moment when the current carrier 104 fuses due to over-temperature, as the melting point of the fuse link 105 is higher than the melting point of the current carrier 104, the fuse link 105 still maintains a conducting state, and the current is all loaded on the fuse link 105, making the fuse link 105 to generate heat. Under a combined action of the increasing heat and the rising temperature, the fuse link 105 reaches its melting point. Under the effect of the tension of the fusing agent 106, the fuse link 105 shrinks rapidly and fuses itself. An arc is inevitably generated during the breaking process. Due to the parallel segments formed by the U-shaped structure, an electric field with high strength is generated in the U-shaped structure, in which electrons repel each other to elongate the arc and accelerate the recombination and diffusion of free electrons and positive ions, thereby quickly cutting off the arc and implementing high-voltage breaking to protect the safety of the circuit.

In the present embodiment, the electrode for connecting the current carrier 104 and the fuse link 105 includes the first electrode plate 107 and the second electrode plate 108. The first electrode plate 107 and the second electrode plate 108 are of the same shape and are mirror-symmetric to facilitate mass production. Each of the first electrode plate 107 and the second electrode plate 108 is a roughly L-shaped structure formed by stamping a conductive metal sheet. The electrode plate is provided with a slot to divide one end (the upper end in the figure) of the electrode plate into two terminals to be connected to one end of the current carrier 104 and one end of the fuse link 105, respectively. Specifically, one end of the first electrode plate 107 is divided into the left terminal 107*a* and the left terminal 107*b*. One end of the second electrode plate 108 is divided into the right terminal 108*a* and the right terminal 108*b*. The two ends of the current carrier 104 are connected to the left terminal 107*a* and the right terminal 108*a*, respectively, and the two ends of the fuse link 105 are connected to the left terminal 107*b* and the right terminal 108*b*, respectively, so as to form an electrical parallel structure of the current carrier 104 and the fuse link 105. The other end (the lower end in the figure) of the first electrode plate 107 is welded to the first lead wire 109, and the other end (the lower end in the figure) of the second electrode plate 108 is welded to the second lead wire 110, so as to form an electrical connection between the first lead wire 109, the first electrode plate 107, the current carrier 104, the fuse link 105, the second electrode plate 108, and the second lead wire 110. In the present embodiment, the first lead wire 109 and the second lead wire 110 are welded to the inner side of the first electrode plate 107 and the inner side of the second electrode plate 108, respectively, and extend vertically downward. The welding between the first lead wire 109 and the first electrode plate 107 as well as the welding between the second electrode plate 108 and the second lead wire 110 are implemented by spot welding using tin solder, ultrasonic metal welding, or the like. The first lead wire 109 and the second lead wire 110 are both multi-stranded wires, such as copper stranded wires, and thus can be bent more flexibly. In addition, each of the first lead wire 109 and the second lead wire 110 is wrapped by an insulating sheath. The material of the insulating sheath is selected from Teflon, silicone rubber, a polyester material and other insulators with good insulation properties. In the present embodiment, the sealant 103 needs to meet filling requirements as follows: the sealant 103 at least covers the weld between the first lead wire 109 and the first electrode plate 107 and an end of the first lead wire 109, and also covers the weld between the second electrode plate 108 and the second lead wire 110 and an end of the second lead wire 110.

In the present embodiment, the cover plate 102 includes the bottom plate 102*e* located at its lower end as well as the first partition plate 102*b*, the second partition plate 102*c*, and the third partition plate 102*d* that are perpendicular to the bottom plate 102*e* and arranged in parallel at intervals. The second partition plate 102*c* separates the parallel segments of the current carrier 104 and the parallel segments of the fuse link 105, while the first partition plate 102*b* and the third partition plate 102*d* are configured to separate the outer side of the current carrier 104 and the outer side of the fuse link 105, respectively. In the present embodiment, one end of each of the first electrode plate 107 and the second electrode plate 108 is provided with a slot and is thus divided into two terminals, which not only facilitates welding the current carrier 104 and the fuse link 105 separately, but also facilitates inserting and mounting the second partition plate 102*c* of the cover plate 102 from the slots of the first electrode plate 107 and the second electrode plate 108. Both sides of the bottom plate of the cover plate 102 are provided with clamping grooves corresponding to the first electrode plate 107 and the second electrode plate 108 for mounting, wherein the clamping grooves have approximately the same width as (usually slightly wider than) the first electrode plate 107 and the second electrode plate 108. In addition, in order to increase the creepage distance to improve safety, the contours of each of the first partition plate 102*b*, the second partition plate 102*c*, and the third partition plate 102*d* have the undulating profiles 102*a*, which, for example, are concave-shaped undulating profiles as shown in the figure of the present embodiment. The top inner wall of the housing 101 is further provided with the ridges 101*a* to increase the creepage distance.

In the present embodiment, the first lead wire 109 and the second lead wire 110 are led out from the same end and extend downward to form a package structure with a radial configuration. The package structure with the radial configuration is more suitable for the main circuit of the PTC heater than the package structure with axial configuration in the prior art, and does not need to fold back the wire harness at one end, which facilitates the mounting operation. In addition, the electrode plates are welded to the lead wires before being led out, and the welds and the ends of the lead wires are sealed with a sealant, so as to achieve a good sealing protection effect, which is in line with the requirements for use in the field of waterproofing.

The present embodiment is applicable to scenarios where the operating voltage is lower than 450 VDC.

Embodiment 2

Figure 3:
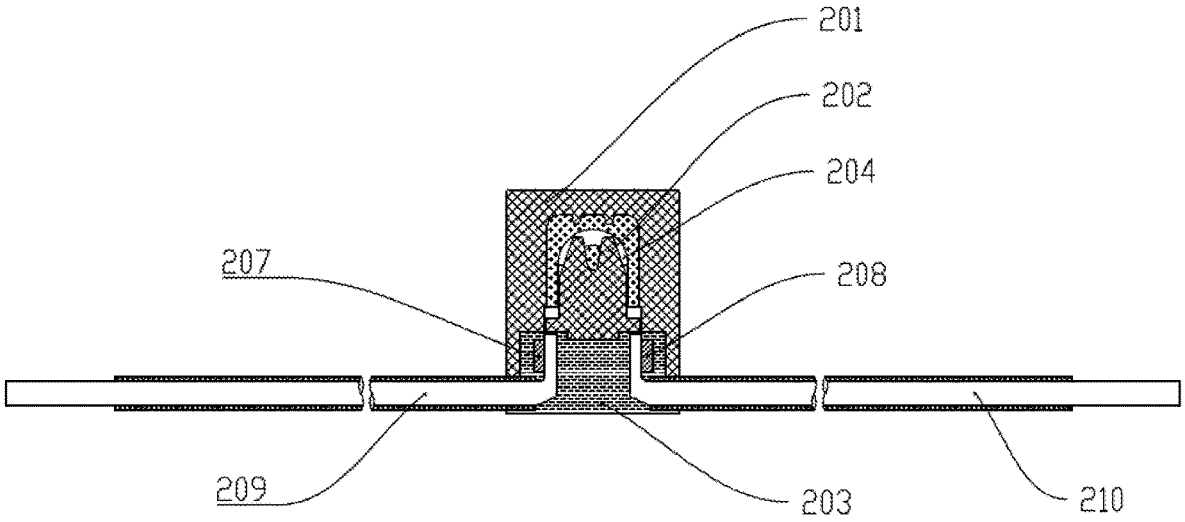
FIG. 3 is a cross-sectional view of a thermal cutoff according to Embodiment 2 of the present invention.
Figure 4:
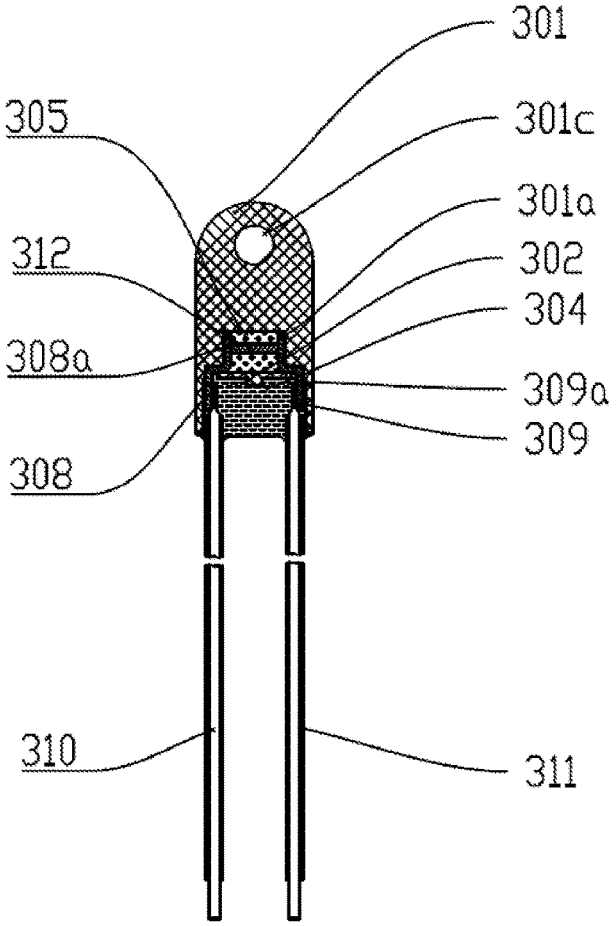
FIG. 4 is a cross-sectional view of a current-carrying fusible element according to Embodiment 3 of the present invention.
Figure 5:
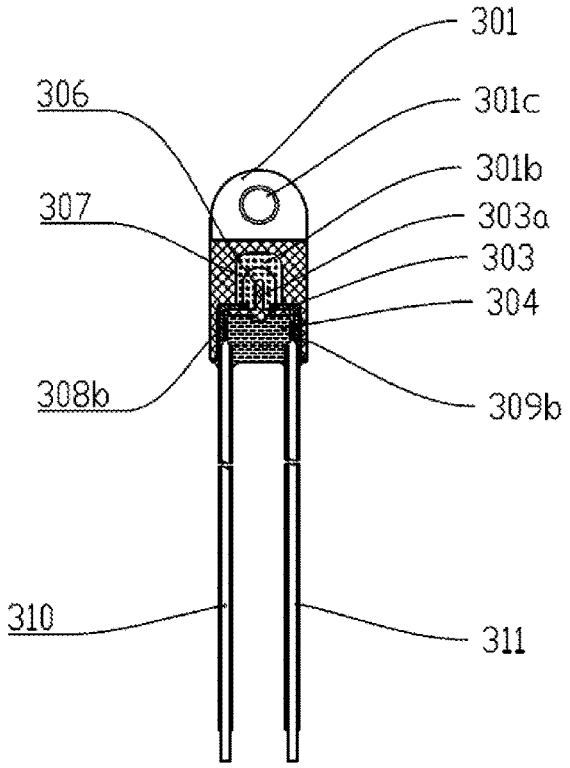
FIG. 5 is a cross-sectional view of a high-voltage fusible element according to Embodiment 3 of the present invention.
Figure 6:
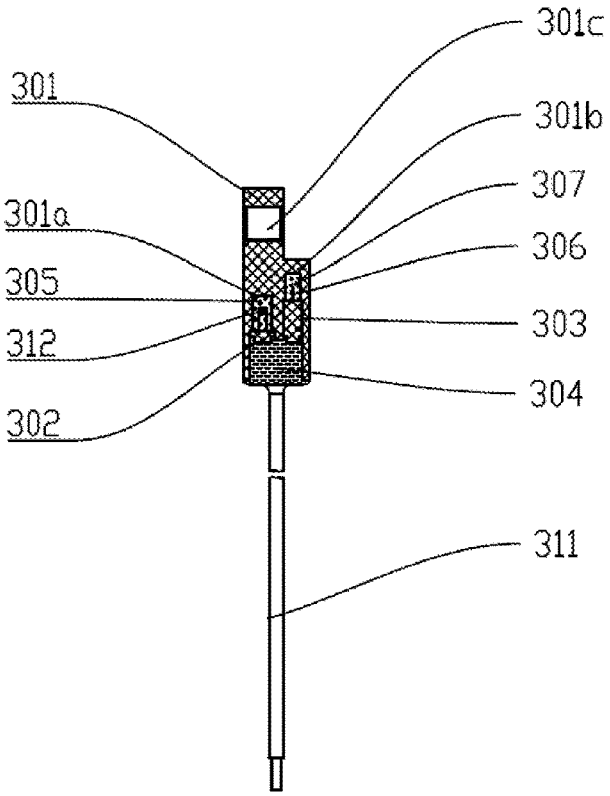
FIG. 6 is a cross-sectional view of a thermal cutoff taken along a central axis according to Embodiment 3 of the present invention.
Figure 7:
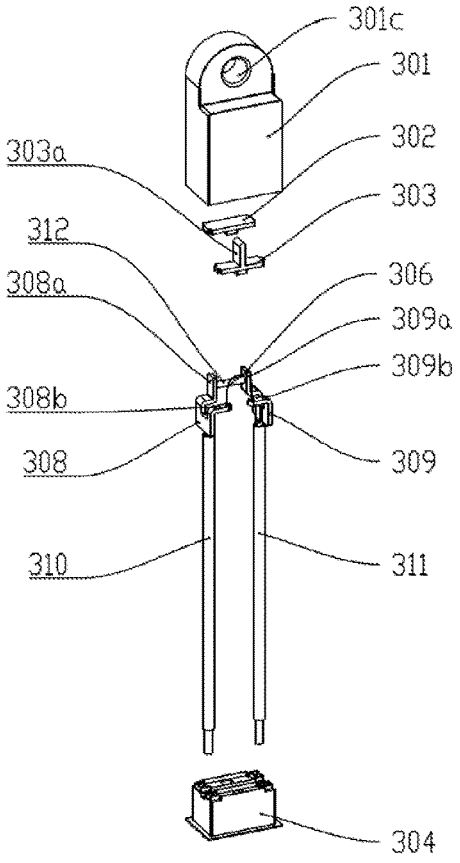
FIG. 7 is a schematic exploded view of the thermal cutoff according to Embodiment 3 of the present invention.

Referring to FIG. 3, Embodiment 2 is similar to Embodiment 1. The thermal cutoff of the present embodiment includes a closed cavity bounded by the housing 201, the cover plate 202, and the sealant 203, as well as a current-carrying fusible element and a high-voltage fusible element implemented by the current carrier 204 and a fuse link (not visible in the figure) in parallel. The cover plate 202 separates the current carrier 204 and the fuse link. The present embodiment differs from Embodiment 1 in that: the pin package mode of the thermal cutoff of the present embodiment is implemented by adopting a package structure with an axial configuration. Specifically, after the first lead wire 209 is welded to the first electrode plate 207 and the second electrode plate 208 is welded to the second lead wire 210, the first lead wire 209 and the second lead wire 210 are bent to be led out towards both sides. In other implementations, it is also feasible to bend the first electrode plate 207 and the second electrode plate 208 in advance and then weld the first lead wire 209 and the second lead wire 210 separately to form a structure with the wires led out towards both sides. Similarly, in the present embodiment, the sealant 203 needs to meet filling requirements as follows: the sealant 203 at least covers the weld between the first lead wire 209 and the first electrode plate 207 and an end of the first lead wire 209, and also covers the weld between the second electrode plate 208 and the second lead wire 210 and an end of the second lead wire 210. Other parts not illustrated are implemented by using the same technical means as those in Embodiment 1, and thus will not be elaborated herein.

In the present embodiment, the package structure with an axial configuration formed by the first lead wire 209 and the second lead wire 210 that are led out from different ends are applicable to other scenarios. For example, when applied to a liquid cooling system, the thermal cutoff is generally mounted above the water and can be directly connected in series in the heating circuit, where the wires are led out axially to facilitate mounting. The circuit type to which the present embodiment is applied is different from that of Embodiment 1, but the thermal cutoff of the present embodiment achieves the same sealing protection effect and is in line with the requirements for use in the field of waterproofing. The present embodiment is applicable to scenarios where the operating voltage is lower than 450 VDC.

Embodiment 3

As shown in FIG. 4 to FIG. 7, in the thermal cutoff of the present embodiment, a current-carrying fusible element and a high-voltage fusible element in parallel are provided as core functional devices in a closed cavity bounded by the housing 301, the first cover plate 302, the second cover plate 303, and the sealant 304. The housing 301 has the first cavity (current-carrying fusing cavity) 301*a* and the second cavity (high-voltage fusing cavity) 301*b* side-by-side corresponding to the current-carrying fusible element and the high-voltage fusible element, respectively. Partition plates are spaced apart between the first cavity 301*a* and the second cavity 301*b*. Preferably, in the present embodiment, the housing 301, the first cover plate 302, the second cover plate 303, and the sealant 304 are made of materials with good insulation properties. For example, the housing 301, the first cover plate 302, and the second cover plate 303 are made of ceramic, and the sealant 304 is made of epoxy resin. It should be noted that, in the present embodiment, the housing 301 in a roughly rectangular shape connected to a semicircular piece is taken as an example for illustration, while the first cover plate 302, the second cover plate 303, and the sealant 304 adapted to the housing 301 also have matching shapes, but the shapes of the housing 301, the first cover plate 302, the second cover plate 303, and the sealant 304 in the present embodiment should not be limited thereto, and a person skilled in the art can adopt different shapes according to different application scenarios and design requirements. In addition, in the present embodiment, the mounting hole 301*c* is provided in the semicircular piece of the housing 301, and the mounting hole 301*c* is configured for mounting and fixing to a protected device.

In the present embodiment, the parallel current-carrying fusible element and high-voltage fusible element serving as the core functional devices are shown as the straight current carrier 312 and the U-shaped fuse link 306 arranged in parallel. The melting point of the current carrier 312 is lower than the melting point of the fuse link 306, and the internal resistance value of the current carrier 312 is lower than the internal resistance value of the fuse link 306. Both ends of the U-shaped fuse link 306 have parallel segments. In this implementation, since the internal resistance value of the current carrier 312 is lower than the internal resistance value of the fuse link 306, when a normal operating current is conducting, the current-carrying capacity is mainly provided by the current carrier 312 serving as the current-carrying fusible element with a lower internal resistance value than the fuse link 306. The current carrier 312 is made of a fusible alloy. The fusible alloy generally refers to metal with a melting point of lower than 300° C. and alloys thereof. For example, the fusible alloy is made of Bi, Sn, Pb, In and other metal elements with low melting points. The fuse link 306 is an electrothermal heating element with a higher fusing temperature, such as a silver-copper alloy, a fusible alloy, a constantan wire, a Fe—Cr—Al heating element, or a nickel-chromium wire.

In the present embodiment, in the closed cavity bounded by the housing 301, the first cover plate 302, the second cover plate 303, and the sealant 304, the first cavity 301*a* and the second cavity 301*b* are filled with the fusing agent 305 and the arc extinguishing medium 307, respectively. The fusing agent 305 contacts and wraps the current carrier 312 provided in the first cavity 301*a*, while the arc extinguishing medium 307 contacts and wraps the fuse link 306 provided in the second cavity 301*b*. The fusing agent 305 is selected from substances capable of reducing the surface tension of an alloy to be fused, for example, a solder paste made of rosin substances (natural rosin, synthetic rosin, and the like). The arc extinguishing medium 307 is selected from an arc extinguishing paste, quartz sand, sulfur hexafluoride, transformer oil, and others. Under normal circumstances, the current mainly flows through the current carrier 312. When a protected device has an abnormal temperature rise, the temperature is transferred to the current carrier 312. When the temperature reaches the melting point of the current carrier 312, the current carrier 312 shrinks and breaks under the effect of the tension of the fusing agent 305, thereby breaking the parallel branch of the current carrier 312. At the moment when the current carrier 312 fuses due to over-temperature, as the melting point of the fuse link 306 is higher than the melting point of the current carrier 312, the fuse link 306 still maintains a conducting state, and the current is all loaded on the fuse link 306, making the fuse link 306 generate heat. Under a combined action of the increasing heat and the rising temperature, the fuse link 306 reaches the melting point. The fuse link 306 shrinks rapidly and fuses itself. An arc is inevitably generated during the breaking process. Due to the parallel segments formed by the U-shaped structure, an electric field with high strength is generated in the U-shaped structure, in which electrons repel each other to elongate the arc and accelerate the recombination and diffusion of free electrons and positive ions, thereby quickly cutting off the arc and implementing high-voltage breaking. In addition, the second cavity 301*b* is filled with the arc extinguishing medium 307 for extinguishing the arc, thereby protecting the safety of the circuit.

It should be noted that similar to the current carrier, the fuse link in the present embodiment in some application scenarios is a fusible alloy made of Bi, Sn, Pb, In and other metal elements with low melting points, provided that the fuse link meets the following requirements by adjusting ratios of the elements: the melting point of the fuse link is higher than the melting point of the current carrier, and the internal resistance value of the fuse link is higher than the internal resistance value of the current carrier. In such an application scenario, the arc extinguishing medium filled in the second cavity of the embodiment is replaced with a fusing agent.

In the present embodiment, the electrode for connecting the current carrier 312 and the fuse link 306 includes the first electrode plate 308 and the second electrode plate 309. The first electrode plate 308 and the second electrode plate 309 are of the same shape and are mirror-symmetric to facilitate mass production. Each of the first electrode plate 308 and the second electrode plate 309 is a roughly L-shaped structure formed by stamping a conductive metal sheet. The electrode plate is provided with a slot to divide one end (the upper end in the figure) of the electrode plate into two terminals to be connected to one end of the current carrier 312 and one end of the fuse link 306, respectively. Specifically, one end of the first electrode plate 308 is divided into the left terminal 308*a* and the left terminal 308*b*. One end of the second electrode plate 309 is divided into the right terminal 309*a* and the right terminal 309*b*. The left terminal 308*a* of the first electrode plate 308 with the L-shaped structure is further bent to form an L-shaped segment, while the left terminal 308*b* is still a straight segment extending laterally. Similarly, the left terminal 309*a* of the second electrode 309 with the L-shaped structure is further bent to form an L-shaped segment, while the left terminal 309*b* is still a straight segment extending laterally. The two ends of the current carrier 312 are connected to the left terminal 308*a* and the right terminal 309*a*, respectively. The two ends of the fuse link 306 are connected to the left terminal 308*b* and the right terminal 309*b*, respectively, to form an electrical parallel structure of the current carrier 312 and the fuse link 306. The other end (the lower end in the figure) of the first electrode plate 308 is welded to the first lead wire 310. The other end (the lower end in the figure) of the second electrode plate 309 is welded to the second lead wire 311 to form an electrical connection between the first lead wire 310, the first electrode plate 308, the current carrier 312, the fuse link 306, the second electrode plate 309, and the second lead wire 311. In the present embodiment, the first lead wire 310 and the second lead wire 311 are welded to the inner side of the first electrode plate 308 and the inner side of the second electrode plate 309, respectively, and extend vertically downward. The welding between the first lead wire 310 and the first electrode plate 308 as well as the welding between the second electrode plate 309 and the second lead wire 311 are implemented by spot welding using tin solder, ultrasonic metal welding, or the like. The first lead wire 310 and the second lead wire 311 are both multi-stranded wires, such as copper stranded wires, and thus can be bent more flexibly. In addition, each of the first lead wire 310 and the second lead wire 311 is wrapped by an insulating sheath. The material of the insulating sheath is selected from Teflon, silicone rubber, a polyester material and other insulators with good insulation properties. In the present embodiment, the sealant 103 needs to meet filling requirements as follows: the sealant 103 at least covers the weld between the first lead wire 310 and the first electrode plate 308 and an end of the first lead wire 310, and also covers the weld between the second electrode plate 309 and the second lead wire 311 and an end of the second lead wire 311.

In the present embodiment, the first cover plate 302 is a long rectangular sheet structure corresponding to a lower opening of the first cavity 301*a* and cooperates with the first cavity 301*a* to enclose the current carrier 312 and the fusing agent 305 in the first cavity 301*a*. The second cover plate 303 includes a bottom plate at its lower end and the partition plate 303*a* perpendicular to the bottom plate. The bottom plate at the lower end corresponds to a lower opening of the second cavity 301*b*, and cooperates with the second cavity 301*b* to enclose the fuse link 306 and the arc extinguishing medium 307 in the second cavity 301*b*. The parallel segments of the fuse link 306 are separated by the partition plate 303*a*, and the partition plate 303*a* is further configured to increase the creepage distance and improve safety. In addition, in order to increase the creepage distance to improve safety, similar to Embodiment 1, a top inner wall of the housing in Embodiment 3 is further provided with ridges or protrusions to increase the creepage distance.

In the present embodiment, the first lead wire 310 and the second lead wire 311 are led out from the same end and extend downward to form a package structure with a radial configuration. The package structure with the radial configuration is more suitable for the main circuit of the PTC heater than the package structure with axial configuration in the prior art, and does not need to fold back the wire harness at one end, which facilitates the mounting operation. In addition, the electrode plates are welded to the lead wires before being led out, and the welds and the ends of the lead wires are sealed with a sealant, so as to achieve a good sealing protection effect, which is in line with the requirements for use in the field of waterproofing. It should be noted that in other application scenarios, it is also feasible to replace the package structure with the radial configuration in Embodiment 3 with a package structure with an axial configuration similar to that in Embodiment 2.

Embodiment 3 achieves the same sealing protection effect as Embodiments 1 and 2, and thus also meets the requirements for use in the field of waterproofing. In addition, compared with Embodiment 1, in Embodiment 3, the current-carrying fusible element and the high-voltage fusible element are spaced apart, and the fuse link 306 serving as the high-voltage fusible element is made of a material with higher voltage withstand capability and is filled with the arc extinguishing medium 307, so as to withstand a high voltage level. The present embodiment is applicable to scenarios where the operating voltage is lower than 850-1000 VDC.

Embodiment 4

Figure 8:
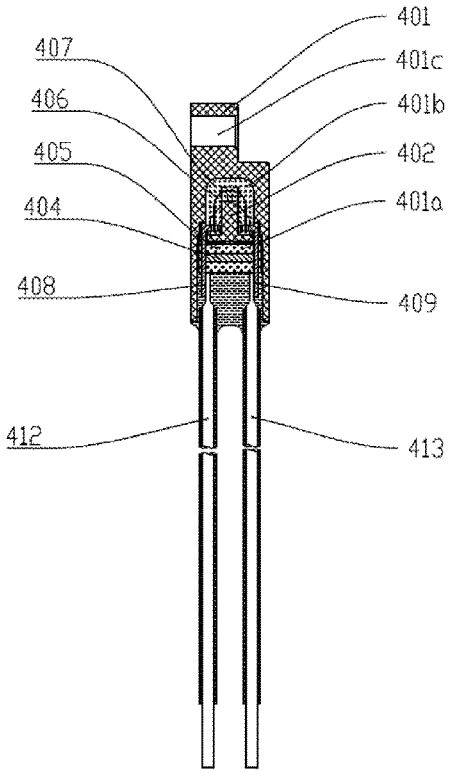
FIG. 8 is a cross-sectional view of a thermal cutoff according to Embodiment 4 of the present invention.
Figure 9:
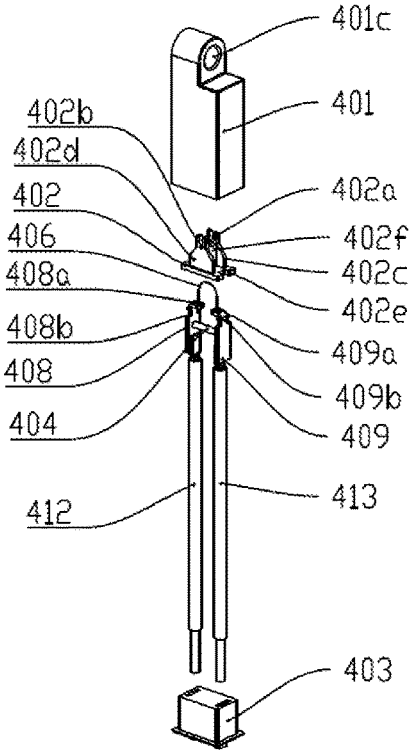
FIG. 9 is a schematic exploded view of the thermal cutoff according to Embodiment 4 of the present invention.

As shown in FIG. 8 and FIG. 9, in the thermal cutoff of the present embodiment, a current-carrying fusible element and a high-voltage fusible element in parallel are provided as core functional devices in a closed cavity bounded by the housing 401, the cover plate 402, and the sealant 403. The housing 401 has the first cavity (current-carrying fusing cavity) 401*a* and the second cavity (high-voltage fusing cavity) 401*b* corresponding to the current-carrying fusible element and the high-voltage fusible element, respectively. The cover plate 402 is inserted into and fitted in the inner cavity of the housing 401 to divide the inner cavity of the housing 401 into the first cavity 401*a* and the second cavity 401*b*. For example, the second cavity 401*b* and the first cavity 401*a* of the present embodiment are arranged vertically as shown in the figure. It should be noted that, in the present embodiment, the housing 401 in a roughly rectangular shape connected to a semicircular piece is taken as an example for illustration, while the cover plate 402 and the sealant 403 adapted to the housing 401 also have matching shapes, but the shapes of the housing 401, the cover plate 402 and the sealant 403 in the present embodiment should not be limited thereto. A person skilled in the art can adopt different shapes according to different application scenarios and design requirements, but the housing 401 is preferably in an elongated shape, such as the shape of a cylinder or a hexagonal prism. An extension direction along the length of the housing 401 in the elongated shape is defined as the vertical direction. The cover plate 402 is inserted into and matches the inner cavity of the housing 401 (where a gap between the cover plate 402 and the housing 401 is also sealed by a small amount of sealant), and is located above the sealant 403 at the lower end, so that the inner cavity of the housing 401 is divided into the second cavity 401*b* and first cavity 401*a* that are spaced apart vertically. Preferably, in the present embodiment, the housing 401, the cover plate 402 and the sealant 403 are made of materials with good insulation properties, for example, the housing 401 and the cover plate 402 are made of ceramic, and the sealant 403 is made of epoxy resin. In addition, in the present embodiment, the mounting hole 401*c* is provided on the semicircular piece of the housing 401, and the mounting hole 401*c* is configured for mounting and fixing to a protected device.

In the present embodiment, the parallel current-carrying fusible element and high-voltage fusible element serving as the core functional devices are shown as the U-shaped fuse link 406 and the straight current carrier 404 arranged vertically. The melting point of the current carrier 404 is lower than the melting point of the fuse link 406, and the internal resistance value of the current carrier 404 is lower than the internal resistance value of the fuse link 406. Both ends of the U-shaped fuse link 406 have parallel segments. In this implementation, since the internal resistance value of the current carrier 404 is lower than the internal resistance value of the fuse link 406, when a normal operating current is conducting, the current-carrying capacity is mainly provided by the current carrier 404 serving as the current-carrying fusible element with a lower internal resistance value than the fuse link 406. The current carrier 404 is made of a fusible alloy. The fusible alloy generally refers to metal with a melting point of lower than 300° C. and alloys thereof. For example, the fusible alloy is made of Bi, Sn, Pb, In and other metal elements with low melting points. The fuse link 406 is also an electrothermal heating element with a higher fusing temperature, such as a silver-copper alloy, a fusible alloy, a constantan wire, a Fe—Cr—Al heating element, or a nickel-chromium wire.

In the present embodiment, in the closed cavity bounded by the housing 401, the cover plate 402, and the sealant 403, the first cavity 401*a* and the second cavity 401*b* are filled with the fusing agent 405 and the arc extinguishing medium 407, respectively. The fusing agent 405 contacts and wraps the current carrier 404 provided in the first cavity 401*a*, while the arc extinguishing medium 407 contacts and wraps the fuse link 406 provided in the second cavity 401*b*. The fusing agent 405 is selected from substances capable of reducing the surface tension of an alloy to be fused, for example, a solder paste made of rosin substances (natural rosin, synthetic rosin, and the like). The arc extinguishing medium 407 is selected from an arc extinguishing paste, quartz sand, sulfur hexafluoride, transformer oil, and the like. Under normal circumstances, the current mainly flows through the current carrier 404. When a protected device has an abnormal temperature rise, the temperature is transferred to the current carrier 404. When the temperature reaches the melting point of the current carrier 404, the current carrier 404 shrinks and breaks under the effect of the tension of the fusing agent 405, thereby breaking the parallel branch of the current carrier 404. At the moment when the current carrier 404 fuses due to over-temperature, as the melting point of the fuse link 406 is higher than the melting point of the current carrier 404, the fuse link 406 still maintains a conducting state, and the current is all loaded on the fuse link 406, making the fuse link 406 to generate heat. Under a combined action of the increasing heat and the rising temperature, the fuse link 406 reaches its melting point. The fuse link 406 shrinks rapidly and fuses itself. An arc is inevitably generated during the breaking process. Due to the parallel segments formed by the U-shaped structure, an electric field with high strength is generated in the U-shaped structure, in which electrons repel each other to elongate the arc and accelerate the recombination and diffusion of free electrons and positive ions, thereby quickly cutting off the arc and implementing high-voltage breaking. In addition, the second cavity 401*b* is filled with the arc extinguishing medium 407 for extinguishing the arc, thereby protecting the safety of the circuit.

It should be noted that similar to the current carrier, the fuse link in the present embodiment in some application scenarios is also a fusible alloy made of Bi, Sn, Pb, In and other metal elements with low melting points, provided that the fuse link meets the following requirements by adjusting ratios the elements: the melting point of the fuse link is higher than the melting point of the current carrier, and the internal resistance value of the fuse link is higher than the internal resistance value of the current carrier. In such an application scenario, the arc extinguishing medium filled in the second cavity of the present embodiment is replaced with a fusing agent.

In the present embodiment, the electrode for connecting the current carrier 404 and the fuse link 406 includes the first electrode plate 408 and the second electrode plate 409. The first electrode plate 408 and the second electrode plate 409 are of the same shape and are mirror-symmetric to facilitate mass production. Each of the first electrode plate 408 and the second electrode plate 409 is a roughly straight structure formed by stamping a conductive metal sheet. One end 408*a* (the upper end in the figure) of the straight first electrode plate 408 and one end 409*a* (the upper end in the figure) of the second electrode plate 409 are bent to form small L-shaped segments serving as a welding table to be connected to the two ends of the U-shaped fuse link 406, respectively. The opposite sides (inner sides) at the middle positions of the first electrode plate 408 and the second electrode plate 409 are connected to the two ends of the straight current carrier 404, respectively, to form an electrical parallel structure of the vertically arranged fuse link 406 and current carrier 404 corresponding to the vertically arranged second cavity 401*b* and first cavity 401*a*, respectively.

In the present embodiment, the cover plate 402 includes the bottom plate 402*e* located at its lower end as well as the first partition plate 402*c*, the second partition plate 402*d* and the third partition plate 402*f* that are perpendicular to the bottom plate 402*e* and arranged in parallel at intervals. The third partition plate 402*f* is perpendicular to both the first partition plate 402*c* and the second partition plate 402*d*. The third partition plate 402*f* separates the parallel segments of the U-shaped fuse link 406, while the first partition plate 402*c* and the second partition plate 402*d* are configured to separate the two outer sides of the fuse link 406, respectively. The first electrode plate 408 and the second electrode plate 409 are provided with the clamping notches 408*b*, 409*b* between the current carrier 404 and the fuse link 406 that are vertically arranged. Both sides of the bottom plate 402*e* of the cover plate 402 are provided with clamping grooves corresponding to the clamping notches 408*b*, 409*b* of the first electrode plate 408 and the second electrode plate 409, so that the cover plate 402 separates the current carrier 404 and the fuse link 406 vertically. In addition, in order to increase the creepage distance to improve safety, the contours of each of the first partition plate 402*c*, the second partition plate 402*d*, and the third partition plate 402*f* have the undulating profiles 402*b*, 402*a*, which, for example, are concave-shaped undulating profiles as shown in the figure of the present embodiment. In addition, in order to increase the creepage distance to improve safety, similar to Embodiment 1, a top inner wall of the housing in Embodiment 4 is further provided with ridges or protrusions to increase the creepage distance.

In the present embodiment, the other end (the lower end in the figure) of the first electrode plate 408 is welded to the first lead wire 412, and the other end (the lower end in the figure) of the second electrode plate 409 is welded to the second lead wire 413, so as to form an electrical connection between the first lead wire 412, the first electrode plate 408, the current carrier 404, the fuse link 406, the second electrode plate 409, and the second lead wire 413. In the present embodiment, the first lead wire 412 and the second lead wire 413 are welded to the inner side of the first electrode plate 408 and the inner side of the second electrode plate 409, respectively, and extend vertically downward. The welding between the first lead wire 412 and the first electrode plate 408 as well as the welding between the second electrode plate 409 and the second lead wire 413 are implemented by spot welding using tin solder, ultrasonic metal welding, or the like. The first lead wire 412 and the second lead wire 413 are both multi-stranded wires, such as copper stranded wires, and thus can be bent more flexibly. Each of the first lead wire 412 and the second lead wire 413 is wrapped by an insulating sheath. The material of the insulating sheath is selected from Teflon, silicone rubber, a polyester material and other insulators with good insulation properties. In the present embodiment, the sealant 403 needs to meet filling requirements as follows: the sealant 403 at least covers the weld between the first lead wire 412 and the first electrode plate 408 and an end of the first lead wire 412, and also covers the weld between the second electrode plate 409 and the second lead wire 413 and an end of the second lead wire 413.

In the present embodiment, the first lead wire 412 and the second lead wire 413 are led out from the same end and extend downward to form a package structure with a radial configuration. The package structure with the radial configuration is more suitable for the main circuit of the PTC heater than the package structure with axial configuration in the prior art, and does not need to fold back the wire harness at one end, which facilitates the mounting operation. In addition, the electrode plates are welded to the lead wires before being led out, and the welds and the ends of the lead wires are sealed with a sealant, so as to achieve a good sealing protection effect, which is in line with the requirements for use in the field of waterproofing. It should be noted that in other application scenarios, it is also feasible to replace the package structure with the radial configuration in Embodiment 4 with a package structure with an axial configuration similar to that in Embodiment 2.

Embodiment 4 achieves the same sealing protection effect as Embodiments 1, 2, and 3, and thus meets the requirements for use in the field of waterproofing. In addition, in Embodiment 4, the current-carrying fusible element and the high-voltage fusible element are spaced apart, and the fuse link 406 serving as the high-voltage fusible element is made of a material with higher voltage withstand capability and is filled with the arc extinguishing medium 407, so as to withstand a high voltage level. The present embodiment is applicable to scenarios where the operating voltage is lower than 850-1000 VDC. In addition, since the current-carrying fusible element and high-voltage fusible element are vertically arranged, in such a structural configuration, the thermal cutoff in the present embodiment is longer and slimmer than that in Embodiment 3, and is thus applicable to some scenarios with specific needs. For example, in a heater of a liquid cooling system, due to the arrangement of the circuit board and other control parts, the space left for the thermal cutoff is relatively small. In this case, since the original parallel arrangement is not suitable for positions with higher space requirements on compactness, the thermal cutoff of the present embodiment can be used instead to meet such application requirements.

Embodiment 5

Figure 10:
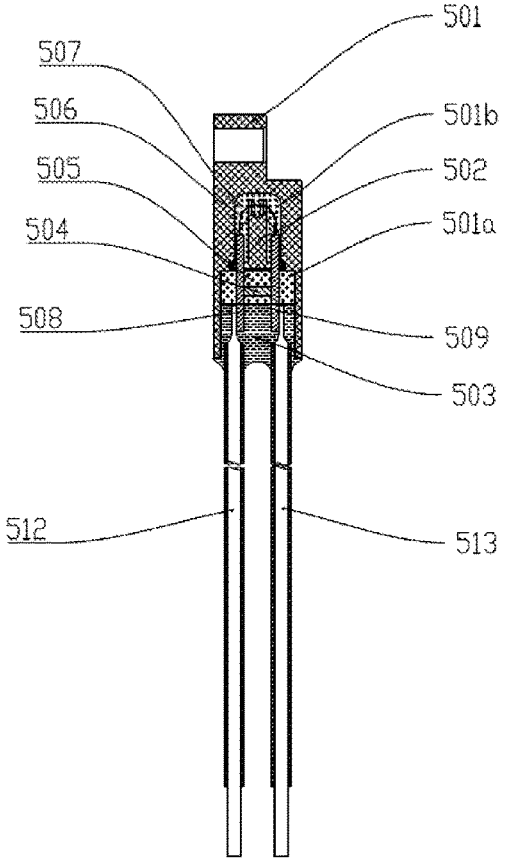
FIG. 10 is a cross-sectional view of a thermal cutoff according to Embodiment 5 of the present invention.

As shown in FIG. 10, the thermal cutoff of Embodiment 5 is substantially the same as that of Embodiment 4. In the thermal cutoff of the present embodiment, a current-carrying fusible element and a high-voltage fusible element in parallel are provided as core functional devices in a closed cavity bounded by the housing 501, the cover plate 502, and the sealant 503. The housing 501 has the first cavity (current-carrying fusing cavity) 501*a* and the second cavity (high-voltage fusing cavity) 501*b* corresponding to the current-carrying fusible element and the high-voltage fusible element, respectively. The cover plate 502 is inserted into and fitted in the inner cavity of the housing 501 to divide the inner cavity of the housing 501 into the first cavity 501*a* and the second cavity 501*b* that are arranged vertically. In the present embodiment, the parallel current-carrying fusible element and high-voltage fusible element are shown as the U-shaped fuse link 506 and the straight current carrier 504 arranged vertically. The melting point of the current carrier 504 is lower than the melting point of the fuse link 506, and the internal resistance value of the current carrier 504 is lower than the internal resistance value of the fuse link 506. In the present embodiment, the first cavity 501*a* and the second cavity 501*b* are filled with the fusing agent 505 and the arc extinguishing medium 507, respectively. The fusing agent 505 contacts and wraps the current carrier 504 provided in the first cavity 501*a*, while the arc extinguishing medium 507 contacts and wraps the fuse link 506 provided in the second cavity 501*b*.

The difference between Embodiment 5 and Embodiment 4 is as follows. In the present embodiment, the first electrode plate 508 and the second electrode plate 509 for connecting the current carrier 504 and the fuse link 506 are roughly straight, identical sheet structures formed by stamping conductive metal sheets, and are mirror-symmetric. The upper end of each of the first electrode plate 508 and the second electrode plate 509 is not bent to form a welding table similar to that in Embodiment 4. The U-shaped fuse link 506 is directly welded to the upper ends of the first electrode plate 508 and the second electrode plate 509. In the present embodiment, the first electrode plate 508 and the second electrode plate 509 are less convenient to weld compared with Embodiment 4, but the stamping process of the electrode plates is simpler to manufacture and thus has certain cost advantages. In addition, another difference of the present embodiment is that the first lead wire 512 is welded to the outer side of the other end (the lower end in the figure) of the first electrode plate 508, and the second lead wire 513 is welded to the outer side of the other end (the lower end in the figure) of the second electrode plate 509. Compared with the welding operation at the inner sides in Embodiment 4, the welding operation in the present embodiment is simpler and more convenient.

Embodiment 6

Figure 11:
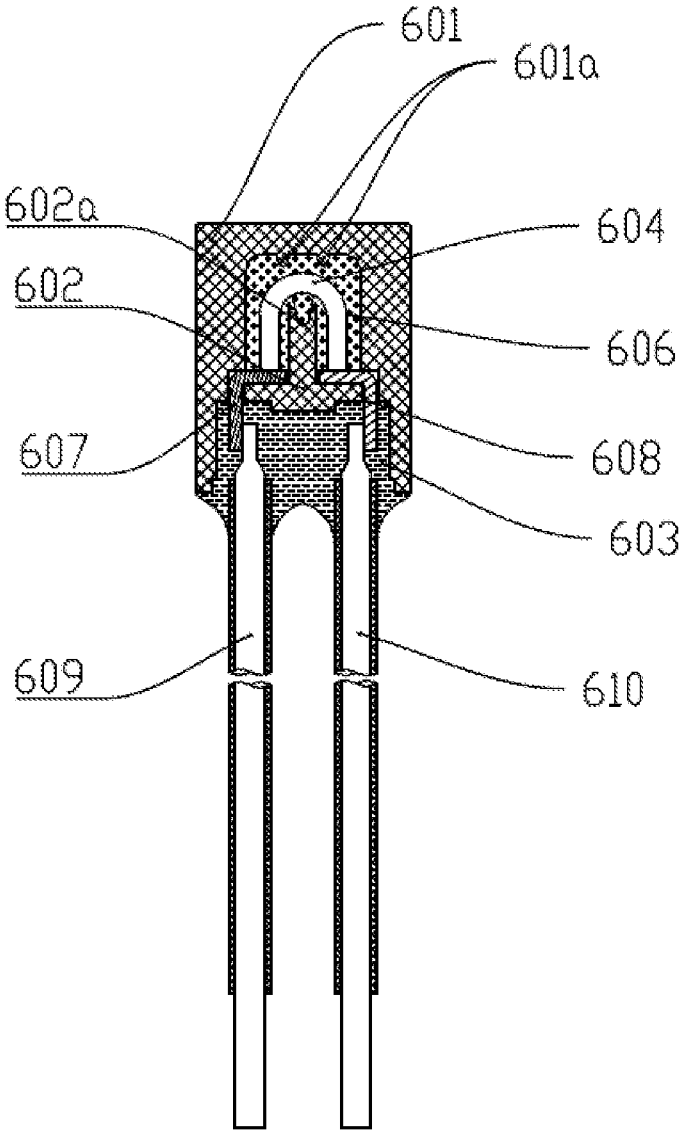
FIG. 11 is a cross-sectional view of a thermal cutoff according to Embodiment 6 of the present invention.

As shown in FIG. 11, in the thermal cutoff of the present embodiment, a current-carrying fusible element is provided as a core functional device in a closed cavity bounded by the housing 601, the cover plate 602, and the sealant 603. Preferably, in the present embodiment, the housing 601, the cover plate 602 and the sealant 603 are made of materials with good insulation properties. For example, the housing 601 and the cover plate 602 are made of ceramic, and the sealant 603 is made of epoxy resin. The housing 601, the cover plate 602, and the sealant 603 in the present embodiment have matching shapes and structures to cooperate with each other. In the present embodiment, the current-carrying fusible element is shown as the U-shaped current carrier 604. Both ends of the U-shaped current carrier 604 have parallel segments. The current carrier 604 is made of a fusible alloy. The fusible alloy generally refers to metal with a melting point of lower than 300° C. and alloys thereof. For example, the fusible alloy is made of Bi, Sn, Pb, In and other metal elements with low melting points.

In the present embodiment, the closed cavity bounded by the housing 601, the cover plate 602, and the sealant 603 is filled with the fusing agent 606. The fusing agent 606 contacts and wraps the current carrier 604. The fusing agent 606 is selected from substances capable of reducing the surface tension of an alloy to be fused, for example, a solder paste made of rosin substances (natural rosin, synthetic rosin and the like). Under normal circumstances, the current mainly flows through the current carrier 604. When a protected device has an abnormal temperature rise, the temperature is transferred to the current carrier 604. When the temperature reaches the melting point of the current carrier 604, the current carrier 604 shrinks and fuses under the effect of the tension of the fusing agent 606, thereby breaking the current. An arc may be generated during the breaking process. Due to the parallel segments formed by the U-shaped structure, an electric field with high strength is generated in the U-shaped structure, in which electrons repel each other to elongate the arc and accelerate the recombination and diffusion of free electrons and positive ions, thereby quickly cutting off the arc and protecting the safety of the circuit.

In the present embodiment, the electrode for connecting the current carrier 604 includes the first electrode plate 607 and the second electrode plate 608. The first electrode plate 607 and the second electrode plate 608 are of the same shape and are mirror-symmetric to facilitate mass production. Each of the first electrode plate 607 and the second electrode plate 608 is a roughly L-shaped structure formed by stamping a conductive metal sheet to form a welding table. The two ends of the current carrier 604 are connected (preferably by welding) to the welding table at the upper ends of the first electrode plate 607 and the second electrode plate 608. The other end (the lower end in the figure) of the first electrode plate 607 is welded to the first lead wire 609, and the other end (the lower end in the figure) of the second electrode plate 608 is welded to the second lead wire 610, so as to form an electrical connection between the first lead wire 609, the first electrode plate 607, the current carrier 604, the second electrode plate 608, and the second lead wire 610. In the present embodiment, the first lead wire 609 and the second lead wire 610 are welded to the inner side of the first electrode plate 607 and the inner side of the second electrode plate 608, respectively, and extend vertically downward. The welding between the first lead wire 609 and the first electrode plate 607 and the welding between the second electrode plate 608 and the second lead wire 610 are implemented by spot welding using tin solder, ultrasonic metal welding, or the like. The first lead wire 609 and the second lead wire 610 are both multi-stranded wires, such as copper stranded wires, and thus can be bent more flexibly. Each of the first lead wire 609 and the second lead wire 610 is wrapped by an insulating sheath. The material of the insulating sheath is selected from Teflon, silicone rubber, a polyester material and other insulators with good insulation properties. In the present embodiment, the sealant 603 needs to meet filling requirements as follows: the sealant 603 at least covers the weld between the first lead wire 609 and the first electrode plate 607 and an end of the first lead wire 609, and also covers the weld between the second electrode plate 608 and the second lead wire 610 and an end of the second lead wire 610.

In the present embodiment, the cover plate 602 includes a bottom plate located at its lower end and a middle partition plate perpendicular to the bottom plate. The middle partition plate separates the parallel segments of the current carrier 604. In addition, in order to increase the creepage distance to improve safety, the contours of the middle partition plate of the cover plate 602 have the undulating profiles 602*a*, which, for example, are concave-shaped undulating profiles as shown in the figure of the present embodiment. A top inner wall of the housing 601 is further provided with the ridges 601*a* to increase the creepage distance.

In the present embodiment, the first lead wire 609 and the second lead wire 610 are led out from the same end and extend downward to form a package structure with a radial configuration. The package structure with the radial configuration is more suitable for the main circuit of the PTC heater than the package structure with axial configuration in the prior art, and does not need to fold back the wire harness at one end, which facilitates the mounting operation. In addition, the electrode plates are welded to the lead wires before being led out, and the welds and the ends of the lead wires are sealed with a sealant, so as to achieve a good sealing protection effect, which is in line with the requirements for use in the field of waterproofing.

The present embodiment is applicable to scenarios where the operating voltage is lower than 220 VDC.

Although the present invention is specifically illustrated and introduced in combination with the preferred embodiments, those skilled in the art should understand that various changes may be made to the present invention in terms of forms and details without departing from the spirit and scope of the present invention defined in the appended claims, such changes shall fall within the scope of protection of the present invention.

The embodiments of the device described above are only schematic, where units described as separate components may or may not be physically separated. Components displayed as units may or may not be physical units, that is, the components may be located in one place, or may be distributed to multiple network units. Some or all of the modules are selected according to actual needs to achieve the objective of the solution of the embodiments. Those of ordinary skill in the art can understand and implement the embodiments without creative efforts.

The phrase "an/one embodiment", "embodiment" or "one or more embodiments" mentioned herein means that a specific feature, structure, or characteristic described in combination with the embodiment is included at least one embodiment of the present invention. In addition, it should be noted that the phrase example "in an/one embodiment" herein does not necessarily refer to the same embodiment.

In the specification provided herein, a large number of specific details are described. However, it can be understood that the embodiments of the present invention can be practiced without specific details. In some embodiments, wellknown methods, structures and techniques are not shown in detail to avoid obscuring the understanding of this specification.

In the claims, any reference sign between brackets should not be constructed as a limitation to the claims. The word "include/comprise" does not exclude the presence of elements or steps not listed in the claims. The word "one" or "a/an" preceding an element does not exclude the existence of multiple such elements. The present invention can be implemented with the assistance of hardware including several different components and the assistance of a properly programmed computer. In the unit claims where several apparatuses are listed, several of the apparatuses may be embodied by the same hardware item. The use of words such as first, second, and third do not indicate any order or sequence. The words may be interpreted as names.

Finally, it should be noted that the foregoing embodiments are merely used to explain the technical solutions of the present invention, rather than to limit the same. Although the present invention is described in detail with reference to the foregoing embodiments, those of ordinary skill in the art should understand that modifications can be made to the technical solutions described in the foregoing embodiments, or equivalent substitutions can be made to some technical features therein. These modifications or substitutions do not make the essence of the corresponding technical solutions deviate from the spirit and scope of the technical solutions of the embodiments of the present invention.

What is claimed is:

1. A thermal cutoff, comprising:

a current-carrying fusible element;

a first lead wire;

a second lead wire;

a closed cavity; and a high-voltage fusible element;

wherein, two ends of the current-carrying fusible element are connected to a first electrode plate and a second electrode plate, respectively;

the closed cavity is bounded by a housing, a cover plate, and a sealant;

the current-carrying fusible element is provided in the closed cavity, wherein one end of the housing is provided with an opening;

each of the first lead wire and the second lead wire is wrapped by an insulating sheath;

one end of the first lead wire and one end of the second lead wire are electrically connected to the first electrode plate and the second electrode plate, respectively;

the sealant is filled in the opening of the housing;

the sealant at least covers an electrical joint between the first lead wire and the first electrode plate and an end of the first lead wire;

the sealant also covers an electrical joint between the second electrode plate and the second lead wire and an end of the second lead wire;

the high-voltage fusible element is arranged in parallel with the current-carrying fusible element;

the high-voltage fusible element is also provided in the closed cavity;

the current-carrying fusible element comprises a current carrier;

the high-voltage fusible element comprises a fuse link;

a melting point of the current carrier is lower than a melting point of the fuse link;

an internal resistance value of the current carrier is lower than an internal resistance value of the fuse link;

at least one of the fuse link and the high-voltage fusible element is U-shaped and has parallel segments at two ends of the at least one of the fuse link and the high-voltage fusible element;

the housing has a cavity;

the current carrier and the fuse link are arranged in parallel in the cavity;

the cavity is filled with a fusing agent;

the fusing agent contacts and wraps the current carrier and the fuse link;

each electrode plate of the first electrode plate and the second electrode plate is a substantially L-shaped structure; and the each electrode plate is provided with a slot to divide one end of the each electrode plate into two terminals to be connected to one end of the current carrier and one end of the fuse link, respectively.

2. The thermal cutoff according to claim 1, wherein the first lead wire and the second lead wire are led out from an identical end and extend downwards to form a package structure with a radial configuration.

3. The thermal cutoff according to claim 1, wherein the first lead wire and the second lead wire are led out from different ends and face towards two sides to form a package structure with an axial configuration.

4. The thermal cutoff according to claim 1, wherein a material of the insulating sheath comprises Teflon, silicone rubber or a polyester material.

5. The thermal cutoff according to claim 1, wherein an inner wall of the housing facing the current-carrying fusible element is further provided with a convex surface to increase a creepage distance.

6. The thermal cutoff according to claim 1, wherein both the current carrier and the fuse link are U-shaped, and both ends of each of the current carrier and the fuse link have parallel segments.

7. The thermal cutoff according to claim 6, wherein the cover plate comprises a bottom plate, a first partition plate, a second partition plate and a third partition plate; wherein the bottom plate is located at a lower end of the cover plate;

the first partition plate, the second partition plate and the third partition plate are perpendicular to the bottom plate and arranged in parallel at intervals;

the second partition plate is inserted into the slot to separate the parallel segments of the current carrier and the parallel segments of the fuse link; and the first partition plate and the third partition plate are configured to separate an outer side of the current carrier and an outer side of the fuse link, respectively.

8. The thermal cutoff according to claim 7, wherein contours of each of the first partition plate, the second partition plate and the third partition plate have undulating profiles to increase a creepage distance.

9. The thermal cutoff according to claim 1, wherein the housing has a first cavity and a second cavity side-by-side;

the current carrier and the fuse link are arranged in parallel in the first cavity and the second cavity, respectively;

the first cavity is further filled with a first fusing agent contacting and wrapping the current carrier, and the second cavity is further filled with an arc extinguishing medium or a second fusing agent contacting and wrapping the fuse link.

10. A thermal cutoff, comprising:

a current-carrying fusible element;

a first lead wire;

a second lead wire;

a closed cavity; and a high-voltage fusible element;

wherein, two ends of the current-carrying fusible element are connected to a first electrode plate and a second electrode plate, respectively;

the closed cavity is bounded by a housing, a cover plate, and a sealant;

the current-carrying fusible element is provided in the closed cavity, wherein one end of the housing is provided with an opening;

each of the first lead wire and the second lead wire is wrapped by an insulating sheath;

one end of the first lead wire and one end of the second lead wire are electrically connected to the first electrode plate and the second electrode plate, respectively;

the sealant is filled in the opening of the housing;

the sealant at least covers an electrical joint between the first lead wire and the first electrode plate and an end of the first lead wire; and the sealant also covers an electrical joint between the second electrode plate and the second lead wire and an end of the second lead wire;

the high-voltage fusible element is arranged in parallel with the current-carrying fusible element;

the high-voltage fusible element is also provided in the closed cavity;

the current-carrying fusible element comprises a current carrier;

the high-voltage fusible element comprises a fuse link;

a melting point of the current carrier is lower than a melting point of the fuse link; and an internal resistance value of the current carrier is lower than an internal resistance value of the fuse link;

the housing has a first cavity and a second cavity side-by-side;

the current carrier and the fuse link are arranged in parallel in the first cavity and the second cavity, respectively;

the first cavity is further filled with a first fusing agent contacting and wrapping the current carrier;

the second cavity is further filled with an arc extinguishing medium or a second fusing agent contacting and wrapping the fuse link;

each electrode plate of the first electrode plate and the second electrode plate is a substantially L-shaped structure, and the each electrode plate is provided with a slot to divide one end of the each electrode plate into two terminals to be connected to one end of the current carrier and one end of the fuse link, respectively.

11. The thermal cutoff according to claim 10, wherein the current carrier is straight, the fuse link is U-shaped, and both ends of the fuse link have parallel segments.

12. The thermal cutoff according to claim 11, wherein the cover plate comprises a first cover plate and a second cover plate;

the first cover plate is a sheet structure corresponding to a lower opening of the first cavity, and the first cover plate cooperates with the first cavity to enclose the current carrier and the fusing agent in the first cavity;

the second cover plate comprises a bottom plate at a lower end of the second cover plate and a partition plate perpendicular to the bottom plate;

the bottom plate at the lower end of the second cover corresponds to a lower opening of the second cavity, and the bottom plate cooperates with the second cavity to enclose the fuse link and the arc extinguishing medium in the second cavity, and the partition plate separates the parallel segments of the fuse link from each other.

13. The thermal cutoff according to claim 1, wherein the housing has a cavity;

the cover plate is inserted into and fitted in the cavity to divide the cavity into a first cavity and a second cavity arranged vertically;

the fuse link and the current carrier are arranged vertically in the first cavity and the second cavity, respectively;

the first cavity is further filled with a first fusing agent contacting and wrapping the current carrier; and the second cavity is further filled with an arc extinguishing medium or a second fusing agent contacting and wrapping the fuse link.

14. The thermal cutoff according to claim 13, wherein each of the first electrode plate and the second electrode plate is a substantially straight structure;

two ends of the fuse link are connected to upper ends of the first electrode plate and the second electrode plate, respectively; and two ends of the current carrier are connected to opposite sides in middle positions of the first electrode plate and the second electrode plate, respectively.

15. The thermal cutoff according to claim 14, wherein the current carrier is straight, the fuse link is U-shaped, and both ends of the fuse link have parallel segments.

* * * * *